US007872845B2

(12) United States Patent
Williams et al.

(10) Patent No.: US 7,872,845 B2
(45) **Date of Patent: *Jan. 18, 2011**

(54) CONTROL SYSTEM

(75) Inventors: Kyle Shawn Williams, Howell, MI (US); Joseph Funyak, Rochester Hills, MI (US)

(73) Assignee: Infineon Technologies AG, Neubiberg (DE)

( * ) Notice: Subject to any disclaimer, the term of this patent is extended or adjusted under 35 U.S.C. 154(b) by 595 days.

This patent is subject to a terminal disclaimer.

(21) Appl. No.: 11/731,722

(22) Filed: Mar. 30, 2007

(65) Prior Publication Data

US 2008/0238391 A1 Oct. 2, 2008

(51) Int. Cl.
*H01H 47/00* (2006.01)
*G05F 1/00* (2006.01)

(52) U.S. Cl. ..... 361/139; 361/152; 323/283

(58) Field of Classification Search ..... 323/283, 323/299; 361/139, 150–154
See application file for complete search history.

(56) References Cited

U.S. PATENT DOCUMENTS 5,160,928 A 11/1992 Rigat-Esselin et al.
5,790,364 A * 8/1998 Mikami et al. ..... 361/154
5,883,536 A 3/1999 Patterson
6,069,471 A 5/2000 Nguyen
6,433,522 B1 8/2002 Siri
6,504,698 B1 * 1/2003 Durif et al. ..... 361/152
6,809,504 B2 10/2004 Tang et al.
6,934,140 B1 * 8/2005 Rober et al. ..... 361/154
7,158,361 B2 1/2007 Horn
7,466,116 B2 12/2008 Sato et al.
7,667,446 B2 * 2/2010 Williams et al. ..... 323/283
2008/0169798 A1 7/2008 Williams et al.

FOREIGN PATENT DOCUMENTS

DE 69800081 T2 9/2000
DE 60309155 T2 8/2007

OTHER PUBLICATIONS

Office Action dated Apr. 15, 2009 issued to U.S. Appl. No. 11/652,344.
Notice of Allowance dated Aug. 28, 2009 issued to U.S. Appl. No. 11/652,344.

* cited by examiner

*Primary Examiner*—Bao Q Vu
*Assistant Examiner*—Jue Zhang
(74) *Attorney, Agent, or Firm*—Eschweiler & Associates, LLC

(57) ABSTRACT

One embodiment relates to a control system. In one embodiment, a control system is configured to drive a load based on a set-point of the load, a measured load characteristic and a supply voltage of the load. The controller is configured to determine a duty cycle based on the load characteristic, the set-point, and the supply voltage. The controller is further configured to drive the load in response to the duty cycle.

32 Claims, 14 Drawing Sheets

CONTROL SYSTEM

BACKGROUND OF THE INVENTION

In many facets of today's rapidly changing economy, successful businesses must deliver quality products and maximize value to their customers to survive. Even in the high-tech electronic controls arena, this simple reality still holds true.

Two ways in which control systems suppliers deliver value is by providing more accurate control solutions and by providing faster controllers. Accordingly, there is a need in the electronics industry to deliver a control system that can quickly and accurately regulate current in a load despite rapid changes in the supply voltage.

SUMMARY OF THE INVENTION

The following presents a simplified summary of the invention in order to provide a basic understanding of some aspects of the invention. This summary is not an extensive overview of the invention, and is neither intended to identify key or critical elements of the invention nor to delineate the scope of the invention. Rather, the purpose of the summary is to present some concepts of the invention in a simplified form as a prelude to the more detailed description that is presented later.

In one embodiment, a control system is configured to drive a load based on a set-point of the load, a measured load characteristic and a supply voltage of the load. The controller is configured to determine a duty cycle based on the load characteristic, the set-point, and the supply voltage. The controller is further configured to drive the load in response to the duty cycle.

The following description and annexed drawings set forth in detail certain illustrative aspects and implementations of the invention. These are indicative of but a few of the various ways in which the principles of the invention may be employed.

DETAILED DESCRIPTION OF THE INVENTION

The present invention will now be described with respect to the accompanying drawings in which like numbered elements represent like parts. The figures and the accompanying description of the figures are provided for illustrative purposes and do not limit the scope of the claims in any way.

Figure 1:
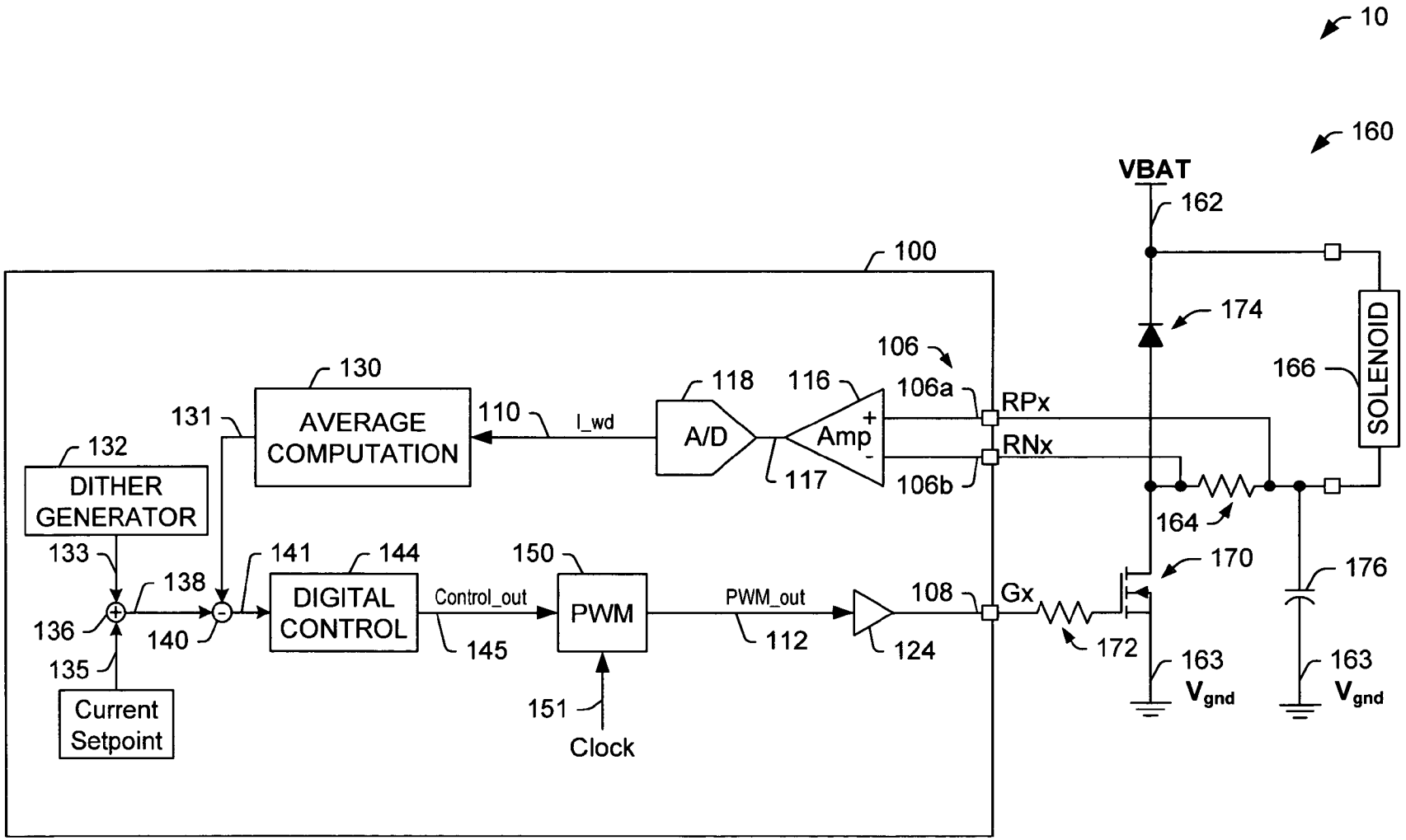
FIG. 1 is a block diagram of one control system for driving a load.

FIG. 1 illustrates one solenoid control system 10 for driving a load. Control system 10 comprises a compensating switching control circuit 100, and an external drive circuit 160. Control system 10 switches a solenoid load 1660N and OFF to provide an average current in the load 166 based on a desired current set-point. Control circuit 100 measures a load current of the solenoid load 166 at a differential input 106, by way of a voltage drop across shunt resistor 164 in series the load 166 based on a current set-point 135 for the load 166. The control circuit 100 computes an average load current, and determines an average current error value based on the computed average. The control circuit 100 also drives the load 166 when operably coupled to an output 108 thereof in response to the corrected set-point.

Control circuit 100 inputs and measures the load current from input 106 using amplifier 116 and analog-to-digital converter (A/D) 118 to create a digital word (I_wd) 110 measurement of the load current. This load current measurement I_wd 110 is then averaged 130 over one or more switching cycles. A dither signal 133 from a dither generator 132 is then summed with the current set-point 135, providing a result 138 which is then subtracted from the computed average load current 131 to provide a current error result 141. The current error result 141 is processed within a digital controller 144 to tailor the control circuit response characteristics which provides a controller output digital word signal Control_out signal 145. A PWM generation block 150, receives the Control_out signal 145, which is then modulated by a clock signal 151 to provide a pulse-width modulated output signal PWM_out 112. In this circuit, the duty cycle of the output signal PWM_out 112 is provided which is proportional to the digital controller output signal Control_out 145. The PWM_out 112 output signal feeds a gate driver 124 which buffers and drives this output signal at output 108 of the control circuit 100.

The external drive circuit 160 includes a shunt resistor 164 connected in series with the load 166, which is driven by a drive transistor 170 which is also driven, via resistor 172, by the drive output 108 of control circuit 100. The external drive circuit 160 receives supply power between supply voltage VBAT 162 and ground voltage Vgnd 163. The external drive circuit also comprises a clamp diode 174 to limit back EMF, and a filter capacitor 176 to smooth the switching. The control system 10 can manage a current that is delivered to the load 206 by selectively increasing or decreasing the current to drive the load with a current that is basically maintained as an average by switching the load at a frequency based on the clock signal 151.

Figure 2A:
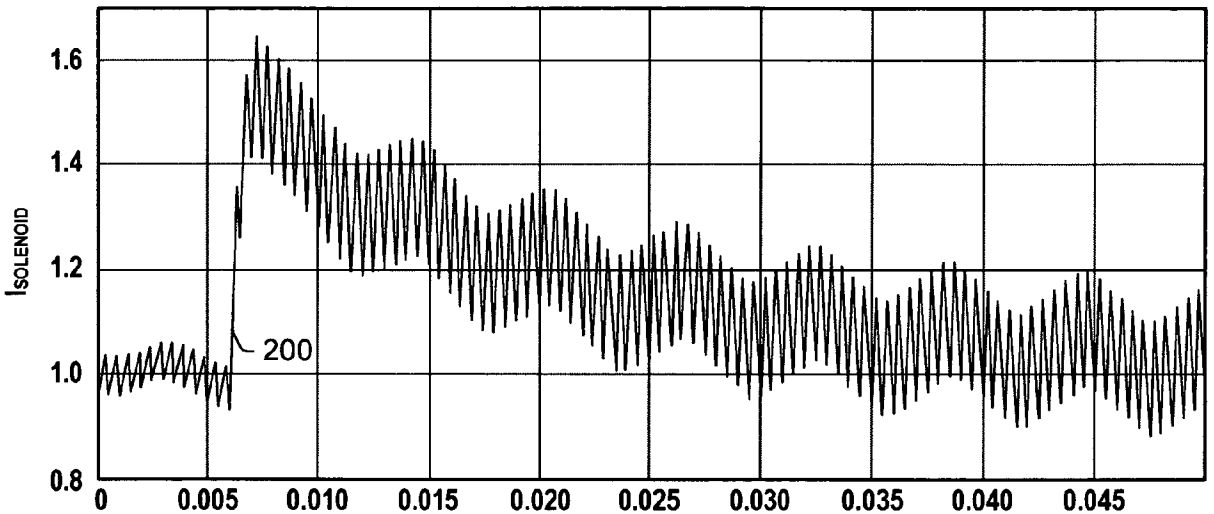
FIGS. 2A and 2B are output solenoid current and supply voltage waveforms, respectively, of the control system of FIG. 1, illustrating the output response to driving the load during a sharply increasing supply voltage transition.
Figure 2B:
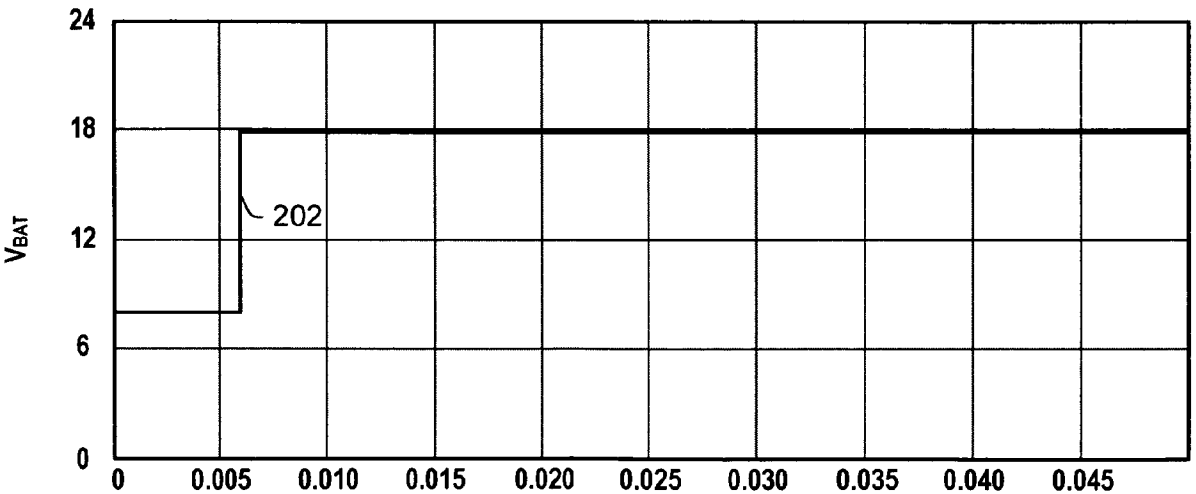

FIG. 2A is the output solenoid current response waveform 200 of the control system 10 of FIG. 1, while driving the load 166 during a sharply increasing supply voltage transition such as that of waveform 202 of FIG. 2B.

Figure 2C:
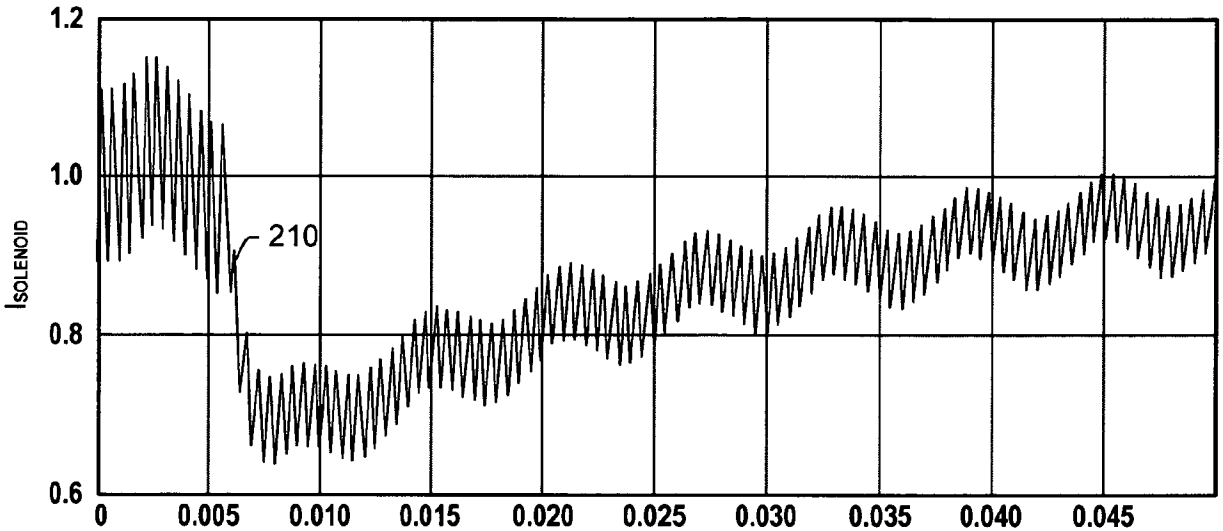
FIGS. 2C and 2D are output solenoid current and supply voltage waveforms, respectively, of the control system of FIG. 1, illustrating the output response to driving the load during a sharply decreasing supply voltage transition.
Figure 2D:
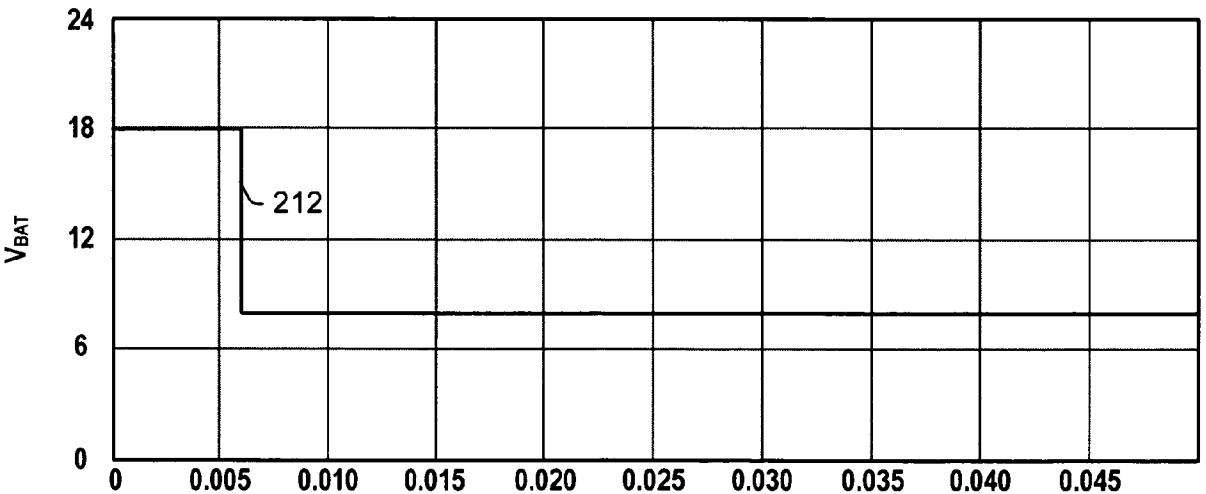

FIG. 2C is the output solenoid current response waveform 210 of the control system 10 of FIG. 1, while driving the load 166 during a sharply decreasing supply voltage transition such as that of waveform 212 of FIG. 2D.

FIGS. 2A and 2C, illustrate a significant overshoot in the solenoid drive current (Isolenoid) 200 and 210 as a result of the sudden transition in the supply voltage VBAT 202 and 212, respectively. In fact, the solenoid current increases from about 1 amp to about 1.5 amps in FIG. 2A during the power supply VBAT 202 transition of FIG. 2B, and requires about 45-50 ms. to recover to a reasonably stable state of about one amp again. Similarly in FIG. 2C, the solenoid current Isolenoid 210 drops from about 1 amp to about 0.7 amp during the power supply voltage VBAT 212 transition of FIG. 2D, and again requires about 45 to 50 ms to recover to a reasonably stable state of about 1 amp. Thus the control circuit of FIG. 1 does eventually regulate the solenoid current to the desired current set-point, however, control circuit 10 of FIG. 1 may not respond rapidly enough to accommodate the expected supply voltage transients of some applications.

Figure 2E:
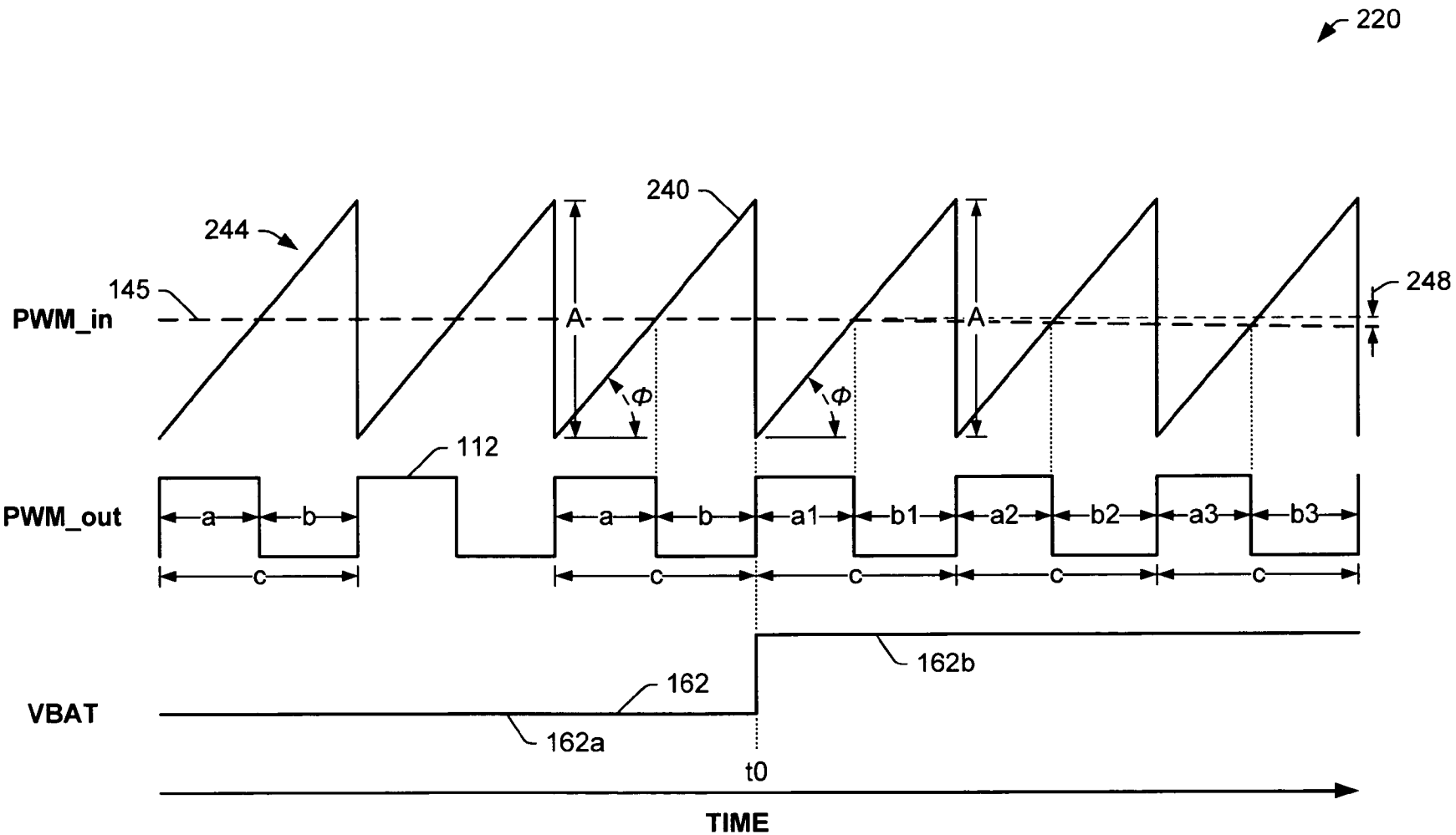
FIG. 2E illustrates several control system waveforms and a supply voltage waveform of the control system of FIG. 1, illustrating the control responses to driving the load during a sharply increasing supply voltage transition.

FIG. 2E illustrates several control system waveforms 220 and a supply voltage waveform VBAT 162 of the control system of FIG. 1, illustrating the control responses to driving the load (e.g., solenoid 166) during a sharply increasing supply voltage VBAT 162 transition.

For example, at time t0, VBAT 162 transitions from a lower supply voltage 162*a* to a higher supply voltage 162*b*. Prior to time t0, Control_out 145 is presumed to be at a reasonably stable state, wherein the average output current (e.g., 131) is about the same as the set-point current (e.g., 135), thus the Control_out 145 signal is stable. Signal 240 of FIG. 2E is the output of a counter inside the PWM generation block 150 which is reset by a clock signal based on the clock signal 151 to establish the PWM time base. The internal PWM signal 240 may be a ramp waveform signal used to modulate the Control_out 145 signal to create PWM_out 112, as produced by the PWM generation block 150 of FIG. 1. In the example control circuit of FIG. 1, signal Control_out 145 and the ramp waveform signal 240 are compared to form PWM_out 112 having a period (c) and a duty cycle comprising an ON time (a) and an OFF time (b). Thus, the duty cycle comprises a ratio of the ON time (a) relative to the OFF time (b), which may be represented as:

$$\text{Duty cycle (on-time)} = \frac{a}{a+b} = \frac{a}{c} \qquad 1)$$

Also, in the example control circuit 100 of FIG. 1, the ramp waveform signal 240 comprises a constant or fixed slope (ϕ) and fixed amplitude (A). At time t0, the power supply voltage VBAT 162 transitions from the lower supply voltage VBAT 162*a* to a higher supply voltage VBAT 162*b*. After time t0, the Control_out 145 signal slowly begins to decrease as the increasing average current 131 in the load is measured and averaged and the difference relative to the current set-point 135 increases. As the Control_out 145 signal decreases, the ON time (e.g., a1, a2, a3) also gradually decreases relative to the OFF time (e.g., b1, b2, b3). This decreasing on-time of the duty cycle eventually causes the current in the solenoid to decrease until the average load current 131 is once again equal to the set-point current 135 at the new higher supply voltage VBAT 162*b*. As shown in FIGS. 2A and 2C, however, this stabilization point may require 45-50 ms of delay in the response time.

The inventors of the present invention, however, have appreciated that such supply voltage response delays may be overcome by the addition of a load supply voltage compensation circuit to dramatically increase the output response rate during rapid supply voltage transitions. In particular, the present invention comprises a voltage supply measurement circuit and an innovative PWM generation circuit block which generates a duty cycle which is not only proportional to the average load current, but is also inversely proportional to the solenoid supply voltage.

In one embodiment, the solenoid supply voltage is converted to a digital word by an analog-to-digital converter. The digital representation of the solenoid supply voltage is an input to the PWM generation block. An increase in the solenoid supply voltage will result in a proportional reduction in the duty cycle. In existing solutions, the duty cycle would typically be corrected by the control circuit, which results in an unavoidable transient disturbance in the output average current to the load.

Figure 3:
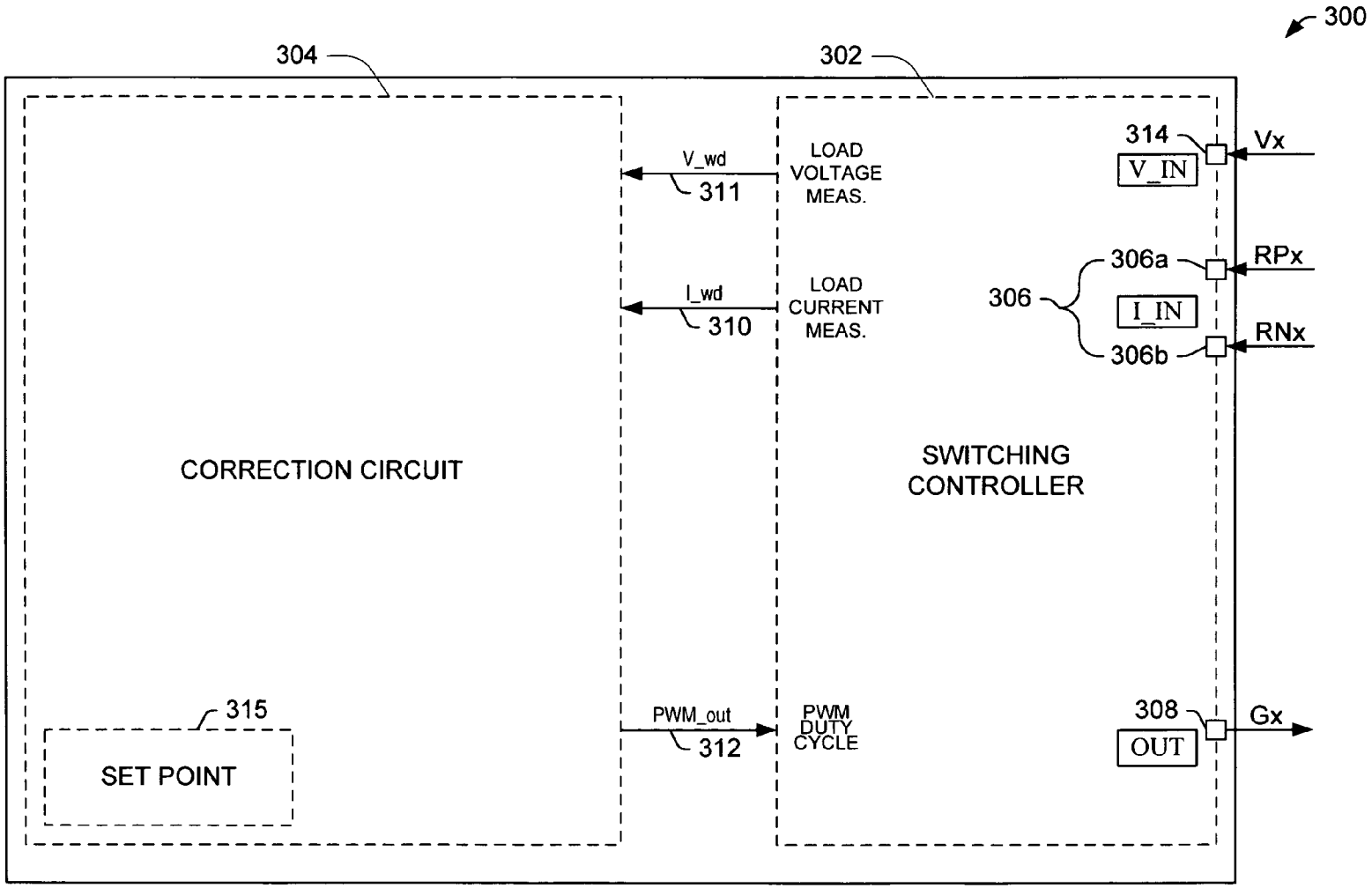
FIG. 3 is a block diagram of one embodiment of a control circuit for driving a load in accordance with various aspects of the present invention.

FIG. 3 illustrates one embodiment of a control circuit 300 for driving a load with a constant current in accordance with various aspects of the present invention. The control circuit 300 comprises a controller 302 configured to measure a load current I_wd 310 of a load (not shown) at an input 306 (e.g., differential inputs RPx 306*a* and RNx 306*b*) thereof and a load voltage V_wd 311 of the load at an input Vx 314 thereof, and further configured to drive the load based on a set-point 315 of the load. The control circuit 300 further comprises a correction circuit 304 configured to determine a duty cycle 312 based on the measured load current I_wd 310, the set-point 315, and the measured load voltage V_wd 311. The controller is also configured to drive the load when operably coupled to an output 308 thereof in response to the duty cycle 312 determined by the correction circuit 304.

In one embodiment, the control circuit or current controller 300 comprises a compensated switching control circuit such as a state machine, a microcontroller, or another such custom integrated circuit. Control circuit 300. control circuit 300 comprises a controller 302 that is configured to digitally measure a load current I_wd 310 (e.g., by way of a measured load current, a voltage, a magnetic field, a light energy, and a power) of a load (in other embodiments, a solenoid, a motor, a light, an inductive load) measured at an input 306 (e.g., differential inputs RPx 306*a* and RNx 306*b*) thereof and a load voltage V_wd 311 of the load at an input Vx 314 thereof, and further can drive the load based on a set-point 315 (in other embodiments, a load current set-point, a voltage set-point, a magnetic field set-point, a light energy set-point, and a power set-point) of the load.

The control circuit 300 of the present embodiment also has a correction circuit 304 that can compute an average load current using the measured load current I_wd 310 over an integer number of cycles (in other embodiments, load switching cycles, clock cycles, or the cycles of another signal time base source). The correction circuit 304 of the embodiment is also configured to combine the computed average load current with the current set-point 315 (in other embodiments, a predetermined, initial set-point, user supplied setting, programmed setting) and a dither signal (in other embodiments, a signal for providing substantially continuous motion to the solenoid to avoid the effects of "sticktion" or overcoming static friction), and to determine an error based on the computed average load current relative to the set-point 315. The correction circuit 304 is further configured to determine a duty cycle PWM_out 312 (e.g., a pulse width modulated (PWM) signal representing an ON and OFF time ratio for switching the load) by modulating (in other embodiments, mixing, comparing, or computing the difference between the two signals or values) the current controller output 345 with the measured supply voltage V_wd 311. The controller 302 is also configured to drive the load when operably coupled thereto at output 308, in response to the duty cycle PWM_out 312 determined by the correction circuit 304.

Figure 4:
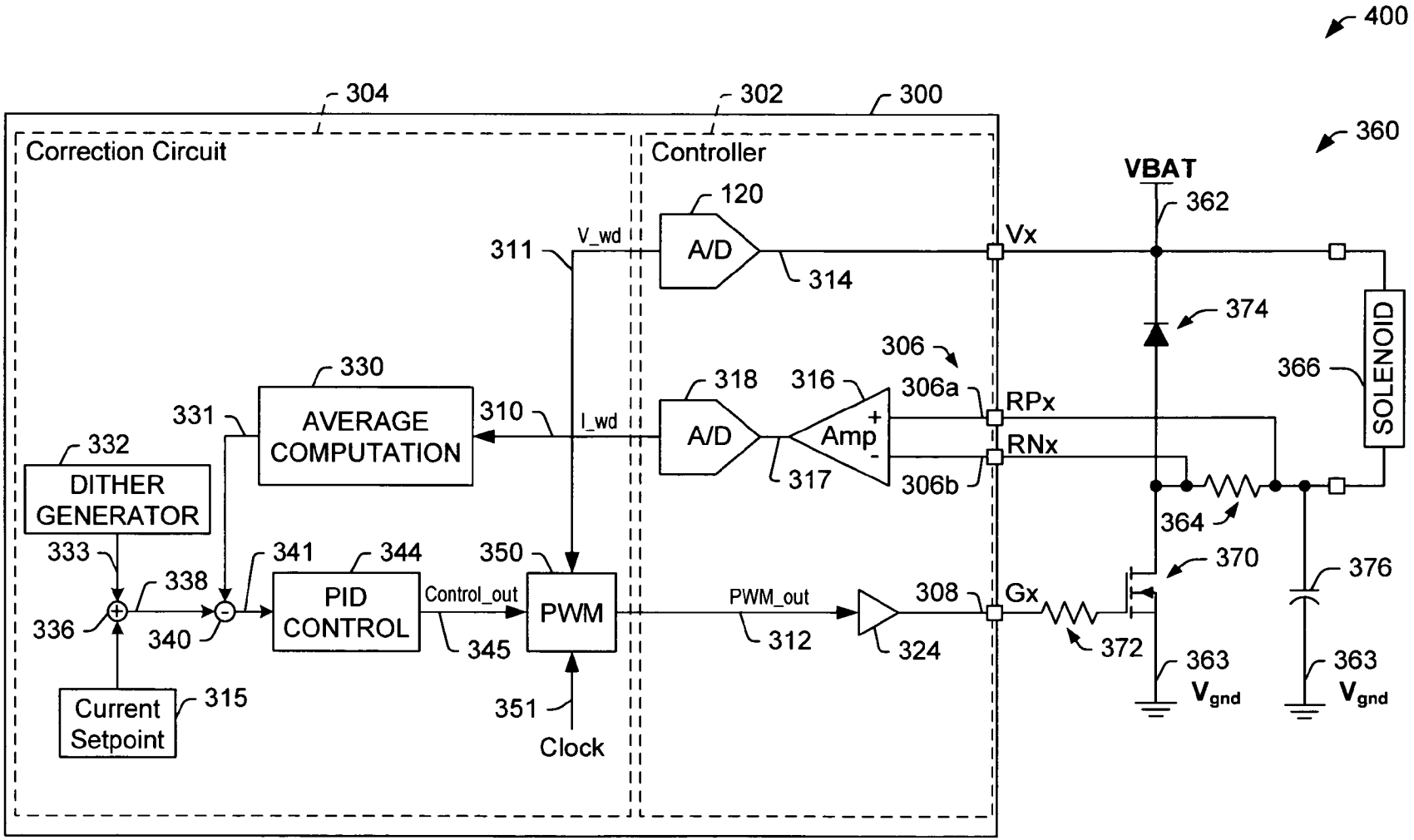
FIG. 4 is a block diagram of one embodiment of a control system for driving a load in accordance with one or more aspects of the present invention.

FIG. 4 illustrates an embodiment of a control system 400 for driving a load in accordance with one or more aspects of the present invention. For example, the control system 400 comprises a compensated solenoid control system 400 suitable for driving an automotive transmission solenoid 366 with a substantially constant current and provides load voltage compensation to the output duty cycle, permitting rapid response to supply voltage transients.

Control system 400 comprises a controller 302, a correction circuit 304, and an external drive circuit 360 including a shunt resistor 364 and a load 366, which are driven by MOS drive transistor 370 driven via series resistor 372 from drive output Gx 308 of controller 302. The external drive circuit 360 receives supply power between supply voltage VBAT 362 and ground voltage Vgnd 363.

The control system 400 of the embodiment can manage, in one embodiment, a current that is delivered to the load 366 (in other embodiments, a solenoid, a motor, a light, or an inductive load) by selectively increasing or decreasing the average duty cycle at which the load is driven by switching, such that a constant average current is maintained by pulse width modulated (PWM) switching the load according to a preset, programmed, or otherwise input current set-point 315. The PWM signal may be provided using a clock signal input, while the frequency of the PWM signal may be determined by the particular load characteristics, the supply voltage used, and other such chosen variables.

In the illustrated embodiment of FIG. 4, the controller 302 has a pair of differential inputs 306*a*, 306*b* which sense a voltage drop across the shunt resistor 364 proportional to the load current thru load 366. A Hall Effect sensor may also be used at the input 306, wherein a magnetic field is associated with the current in the load 366, and a voltage proportional to the magnetic field may be provided as the load current input. Thus, as the current through the shunt resistor 364 or Hall Effect sensor, for example, increases, the shunt resistor or sensor voltage typically increases proportionally. Similarly, as the current through the sensor decreases, the sensor voltage typically decreases proportionally, although other conventions could also be used.

After the shunt resistor 364 provides the sensed voltage, the sensed voltage (representing the load current) travels to the pair of differential inputs 306*a*, 306*b* of the controller 302, one embodiment of which is now discussed in more detail.

Differential amplifier 316 senses the differential voltage at 306*a*, 306*b*, for example, or another such load characteristic (in other embodiments, a load current, a voltage, a magnetic field, a light energy, and a power) indicative of the load, which is communicated at 317 to an analog to digital converter A/D 318, which are well known in the art. A/D 318 provides a digital measurement of the load current I_wd 310, or another such load characteristic to a digital averaging functional block 330 in the correction circuit 304. The averaging functional block 330 may, for example, provide a computed average load current 331 over one or more load switching cycles, for example, PWM switching cycles, PWM duty cycle periods "c", or clock signal 351 cycles.

In the present embodiment of FIG. 4, a desired set-point 315 (e.g., in one embodiment with a digital representation of the desired current set-point) of the average load current is then summed in a digital summer 336 with a dither signal 333 provided by a dither generator 332 to provide a summation result 338 thereof.

In one embodiment, the dither generator 332 provides a periodic wave 333 that is a triangular wave of approximately 150 to 200 Hz that corresponds to the frequency at which the load oscillates about an initial set-point established by the current set-point 315. For example, in one embodiment where the load 366 includes a solenoid, the dither block 332 provides a periodic wave that is superimposed on the average current 331 to move the solenoid armature back and forth to avoid static friction (stiction).

The computed average load current 331 is then subtracted by a digital subtractor 340, in the embodiment of FIG. 4, from the summation result 338 to provide a current error signal or result 341. The current error signal 341 effectively reflects the difference between the desired set-point current 315 and the computed average load current 331. Because the dither signal only adds an AC component and no DC component to the summation result 338 or to the current error signal 341, the dither signal 333 does not affect the overall average output current as seen by the load 366, when averaged over one or more periods of the dither signal 333.

In the present embodiment of FIG. 4, the current error signal 341 is then processed within a proportional-integral-derivative (PID) controller 344 that adjusts or otherwise tailors the response characteristics of the control circuit 300. For example, coefficients of the proportional, integral, and derivative parameters reflecting the control loop behavior may be preset or preprogrammed within the control circuit 300 chip to provide a balance of stable response characteristics over the anticipated range of load, mode control, and supply voltage conditions of the intended application. The PID controller 344 thus processes the current error signal 341 to provide a controller output signal Control_out 345. A PWM generation block 350, receives the Control_out 345 signal and a clock signal 351 as a time base, and modulates the Control_out 345 signal with the measured load voltage V_wd 311, to provide a pulse-width modulated output signal PWM_out 312. The load voltage VBAT 362 is received at Vx 314 and converted from an analog voltage to a digital word representing the measured load voltage V_wd 311.

The inventors of the present invention have also appreciated that in another embodiment, the load voltage VBAT 362 received at Vx 314, may further be filtered either before entering Vx 314 such as by the use of an external filter capacitance or after Vx 314 such as by using an additional low-pass filter element between Vx 314 and the A/D converter 120, for example.

In the control circuit 300, the duty cycle (e.g., percent ON-time) of the output signal PWM_out 312 is proportional to the load current (e.g., load current set point 315), and is inversely proportional to the load voltage (e.g., V_wd 311).

Thus, the duty cycle may also be represented as:

$$\text{Duty Cycle (on-time)} = \frac{\text{load_current} \cdot (\text{load_resistance} + \text{shunt_resistance})}{\text{load_voltage}} \quad 2)$$

By contrast to the circuit of FIG. 1, and in one embodiment of the present invention of FIG. 4, the addition and use of the load voltage V_wd 311 input to the PWM generation block 350, permits the optimal setting of the coefficients of the PID controller 344 independent of the value of the supply voltage. The circuit of FIG. 1 requires either a compromised setting of the coefficients in order to generate acceptable performance over the operating range of the supply voltage, or a means to adjust the coefficients depending on the measured value of the supply voltage. The circuit of FIG. 4, in accordance with the present invention, eliminates the dependence of the dynamic closed loop response on the supply voltage.

Thereafter, output signal PWM_out 312 feeds a gate driver 324 which buffers and drives this output signal at output 308 of the control circuit 300.

In one embodiment of the controller 302, the PWM_out 312 drive signal to the gate driver 324 may, for example, be delayed or be otherwise related to the input signals received by the PWM functional block 350, or by some other state-machine included in the PWM functional block 350 in one embodiment. The gate driver or another such output driver 324 may amplify or otherwise condition the signal to provide the drive signal at 308 to a field effect transistor FET 370. In one embodiment, the output driver 324 may be a single ended or a differential driver capable of driving one or more external or internal drive transistors, for example.

The external drive circuit 360 comprises a shunt resistor 364 connected in series with the load 366 (e.g., solenoid), which is driven by a drive transistor 370 which is also driven, via resistor 372 from the drive output 308 of control circuit 300. The external drive circuit 360 receives supply power between supply voltage VBAT 362 and ground voltage Vgnd 363. The external drive circuit 360 also comprises a clamp diode 374 to limit back EMF and a low pass filter capacitor 376 to smooth the switching. The control system 400 can thus manage a current that is delivered to the load 366 by selectively increasing or decreasing the average duty cycle at which the load is driven by switching, such that a constant average current is maintained by pulse width modulated (PWM) switching the load according to a preset, programmed, or otherwise input current set-point 315. The PWM signal may be provided using a clock signal input 351, while the frequency of the PWM signal may be determined or predetermined by the particular load characteristics, the supply voltage used, and other such chosen variables.

Thus the present embodiment of the invention may be used to regulate the average load current of a load, for example, a load current of a solenoid.

In one embodiment of the correction circuit 304, a synchronous serial peripheral interface or another such interface may be used to supply the initial settings for the required load current set-points 315 (in one embodiment, a 500 mA load current), the amplitude of the dither signal 333 (in one embodiment 150 mA P-P), the dither frequency (in one embodiment 175 Hz), PWM clock signal 351 frequency (in one embodiment 1-2 KHz), for example.

In an embodiment of the correction circuit 304, the digital summer functional block 336 and the digital subtractor 340 may comprise a digital adder or subtractor, or another such processor function capable of summing or mixing the current set-point 315, the dither signal 333, and the computed average current 331, to provide the current error signal 341.

Figure 5A:
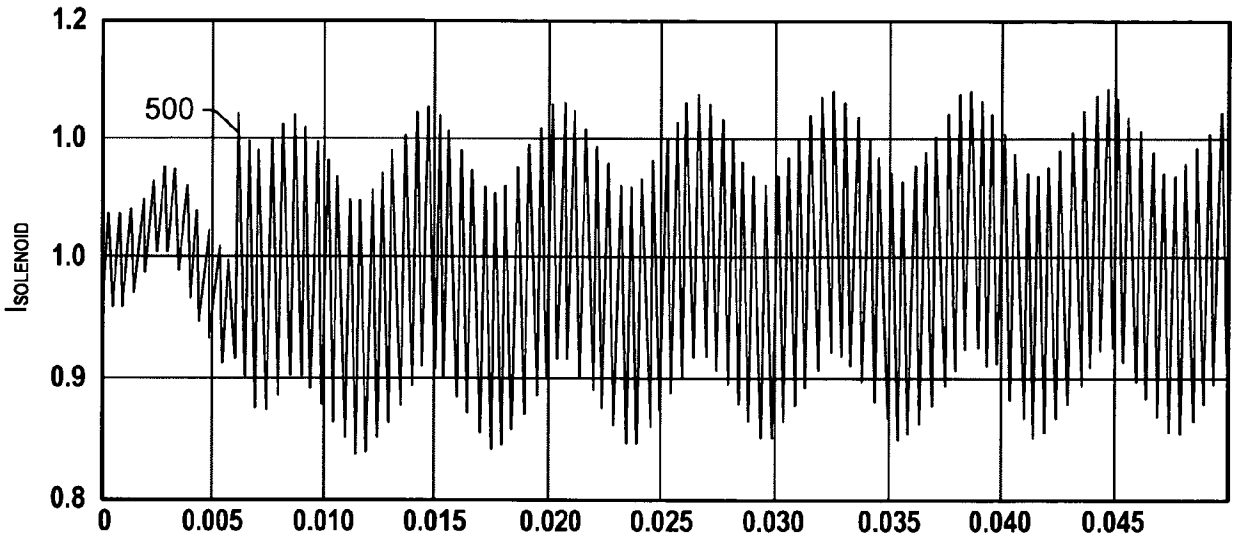
FIGS. 5A and 5B are output solenoid current and supply voltage waveforms, respectively, of the control circuits of FIGS. 3 and 4, illustrating the improved output response to driving the load during a sharply increasing supply voltage transition.
Figure 5B:
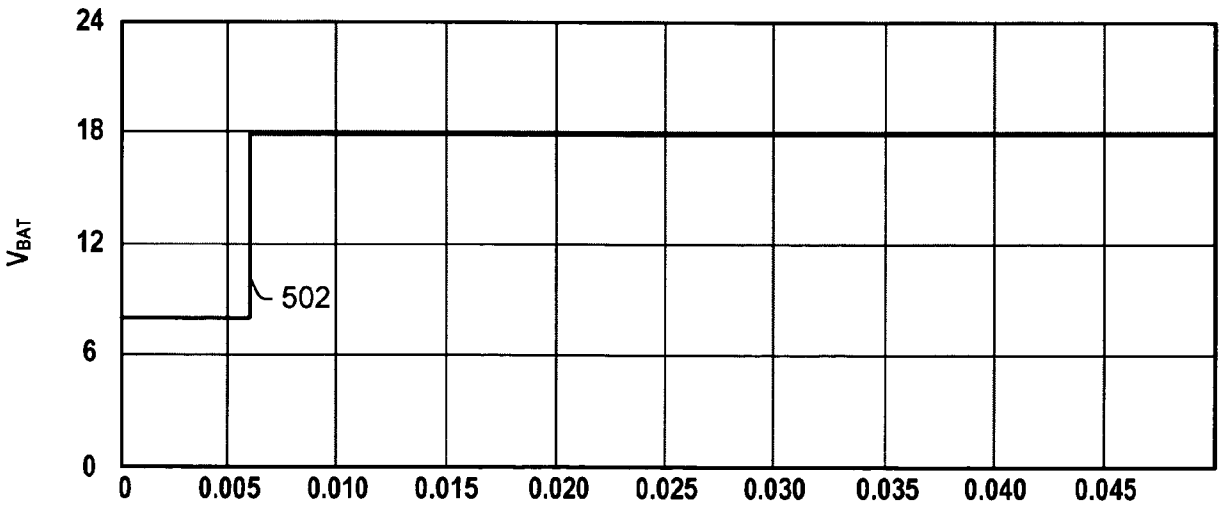

FIG. 5A is an output solenoid current response waveform 500 of the control circuits 300 of FIGS. 3 and 4, illustrating the improved output current 500 response to driving the load 366 during a sharply increasing transition of the supply voltage VBAT such as that of waveform 502 of FIG. 5B.

Figure 5C:
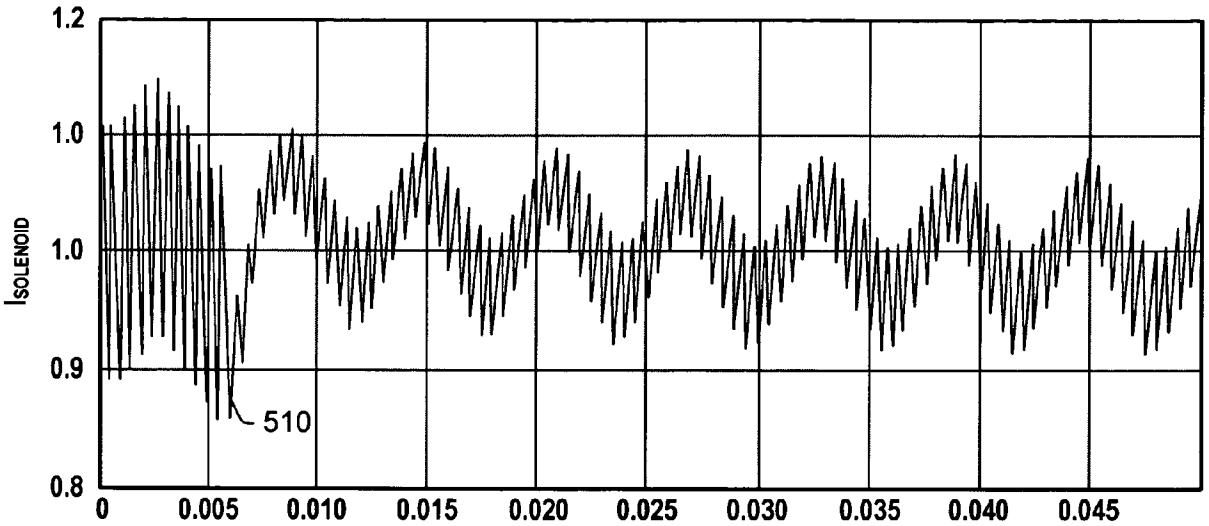
FIGS. 5C and 5D are output solenoid current and supply voltage waveforms, respectively, of the control circuits of FIGS. 3 and 4, illustrating the improved output response to driving the load during a sharply decreasing supply voltage transition.
Figure 5D:
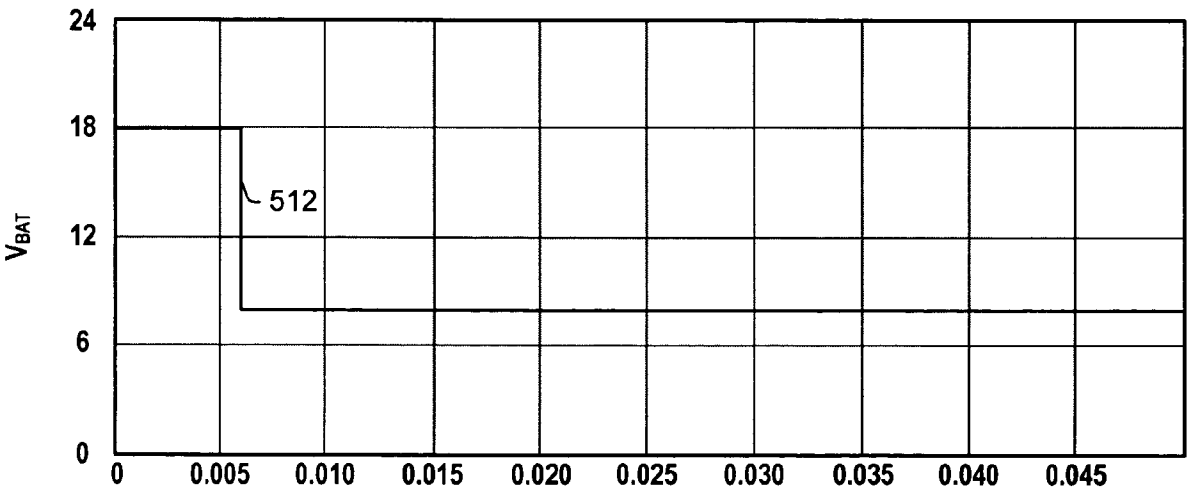

FIG. 5C is an output solenoid current response waveform 510 of the control circuits 300 of FIGS. 3 and 4, illustrating the improved output current 510 response to driving the load 366 during a sharply decreasing transition of the supply voltage VBAT such as that of waveform 512 of FIG. 5D.

FIGS. 5A and 5C, illustrate a significantly diminished overshoot in the solenoid drive current (Isolenoid) 500 and 510 as a result of the sudden transition in the supply voltage VBAT 502 and 512, respectively. In fact, it can be observed that the average solenoid current, for example, over about one dither cycle period 504, remains at the initial level of about 1 Amp in both of the figures. For example, in FIG. 5A during the positive-going transition of power supply VBAT 502 of FIG. 5B, only one switch cycle or PWM period "c" is needed to restore a reasonably stable current level of about one amp again. Similarly in FIG. 5C, during the negative-going transition of power supply VBAT 512 of FIG. 5D, only one switch cycle or PWM period "c" is needed to restore a reasonably stable current level of about one amp again. Thus, the control circuit 300 of FIGS. 3 and 4 nearly instantly regulates the load current I_wd 310 of the solenoid or another such load 366 to the desired current set-point 315, thereby providing a rapid response sufficient to accommodate the supply voltage transients of the anticipated applications.

Figure 5E:
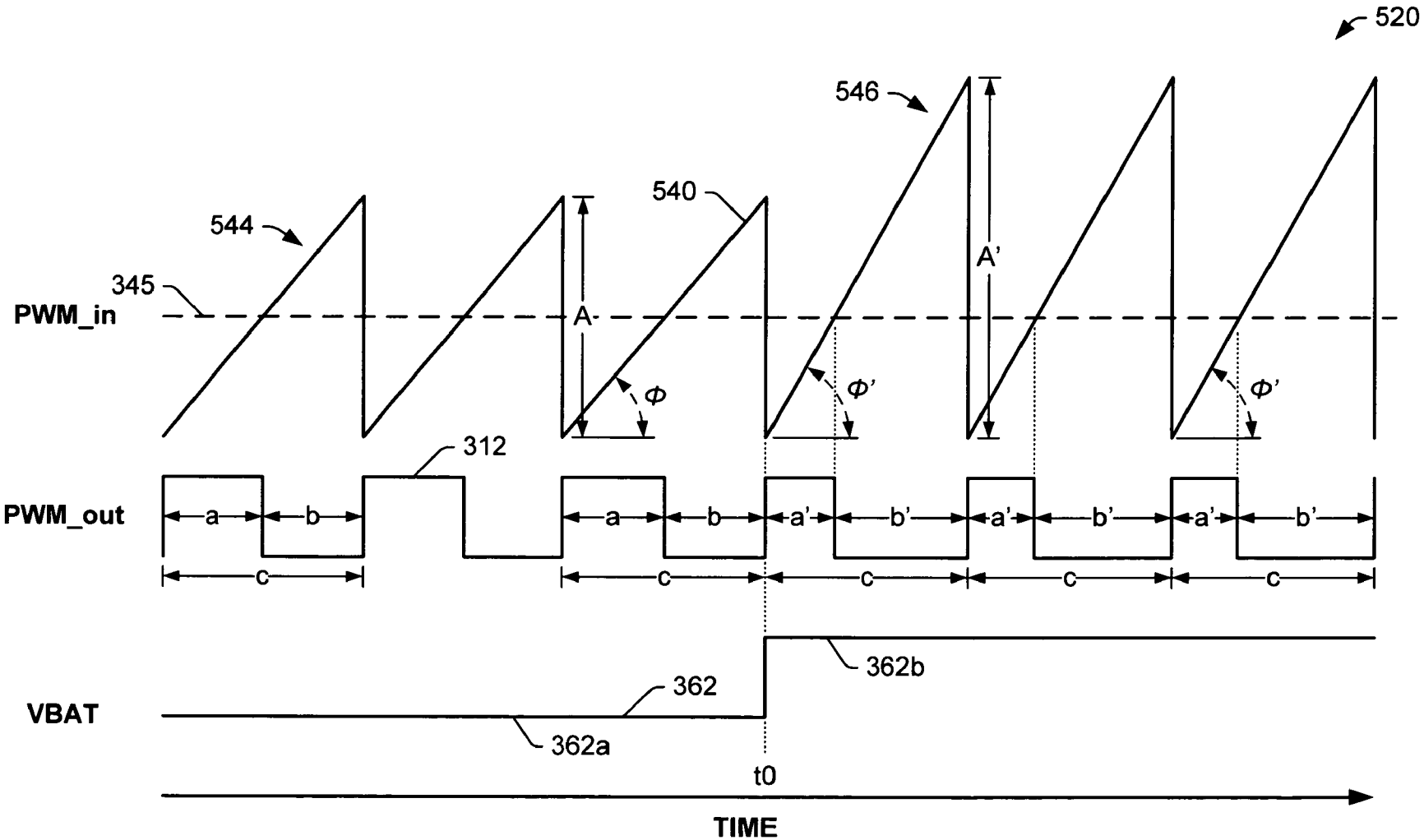
FIG. 5E illustrates several control system waveforms and a supply voltage waveform of the control circuits of FIGS. 3 and 4, illustrating the control responses to driving the load during a sharply increasing supply voltage transition.

FIG. 5E illustrates several control system waveforms 520 and a supply voltage waveform VBAT 562 of the control circuits 300 and system 400 of FIGS. 3 and 4, illustrating the control responses to driving the load (e.g., solenoid 366) during a sharply increasing transition of the supply voltage VBAT 362.

For example, at time t0, VBAT 362 transitions from a lower supply voltage 362*a* to a higher supply voltage 362*b*. Prior to time t0, error signal Control_out 345 is presumed to be at a reasonably stable state, wherein the average output current (e.g., 331) is about the same as the set-point current (e.g., 315), thus the Control_out 345 signal is stable. Signal 540 of FIG. 5E is the output of a counter inside the PWM generation block which is reset by a clock signal based on the clock signal 351 to establish the PWM time base. The internal PWM signal 540 is a sawtooth or ramp waveform signal used to modulate the Control_out 345 signal to create PWM_out 312, as produced by the PWM generation block 350 of FIGS. 3 and 4. In the example control circuit 300 of FIGS. 3 and 4, signal Control_out 345 and the ramp waveform signal 540 may be compared then modulated by the load voltage measurement V_wd 311 to form output signal PWM_out 312. Output signal PWM_out 312 has a period (c) and a duty cycle comprising an ON time (a) and an OFF time (b). The duty cycle of the output signal PWM_out 312, comprises a ratio of the ON time (a) relative to the OFF time (b), wherein the duty cycle is proportional to the load current (e.g., load current set point 315), and is also inversely proportional to the load voltage (e.g., V_wd 311).

Thus, the duty cycle may also be represented as:

$$\text{Duty cycle (on-time)} = \frac{a}{a+b} = \frac{a}{c} = \frac{\text{load_current} \cdot (\text{load_resistance} + \text{shunt_resistance})}{\text{load_voltage}} \quad 3)$$

Also, in the example control circuit 300 of FIGS. 3 and 4, the slope (ϕ) and amplitude (A) of the ramp waveform signal 540 are modulated by the power supply voltage VBAT 362 by way of the measured load voltage V_wd 311 compensation for the current in the load 366. Prior to time t0, and while the circuit 300 and current are in a stable condition, the ramp waveform signal 540 has a slope (ϕ) and amplitude (A) as shown at 544. At time t0, the power supply voltage VBAT 362 transitions from the lower supply voltage VBAT 362*a* to a higher supply voltage VBAT 362*b*. After time t0, the Control_out 345 signal remains stable. At the same time, however, the measured load voltage V_wd 311 compensation input to the PWM functional block 350 also causes an immediate increase in the ramp waveform 540 from slope (ϕ) and amplitude (A) to slope (ϕ') and amplitude (A') as shown at 546. The increased slope rate (ϕ') and amplitude (A') reflected in the PWM output counter signal 540 causes an immediate decrease in the on-time of the duty cycle and a substantially stable load current at the new higher supply voltage VBAT 362*b*.

As shown in FIGS. 5A and 5C, the circuits and systems of the present invention achieve this new circuit stabilization point nearly instantaneously, thereby compensating for load voltage changes or transients.

The inventors of the present invention have thus appreciated that such supply voltage response delays may be overcome by the addition of a load voltage compensation or correction circuit to dramatically increase the output response rate during rapid supply voltage transitions. In particular, the present invention comprises a voltage supply measurement circuit and an innovative PWM generation circuit block which generates a duty cycle which is not only proportional to the average load current, but is also inversely proportional to the solenoid supply voltage.

Figure 6:
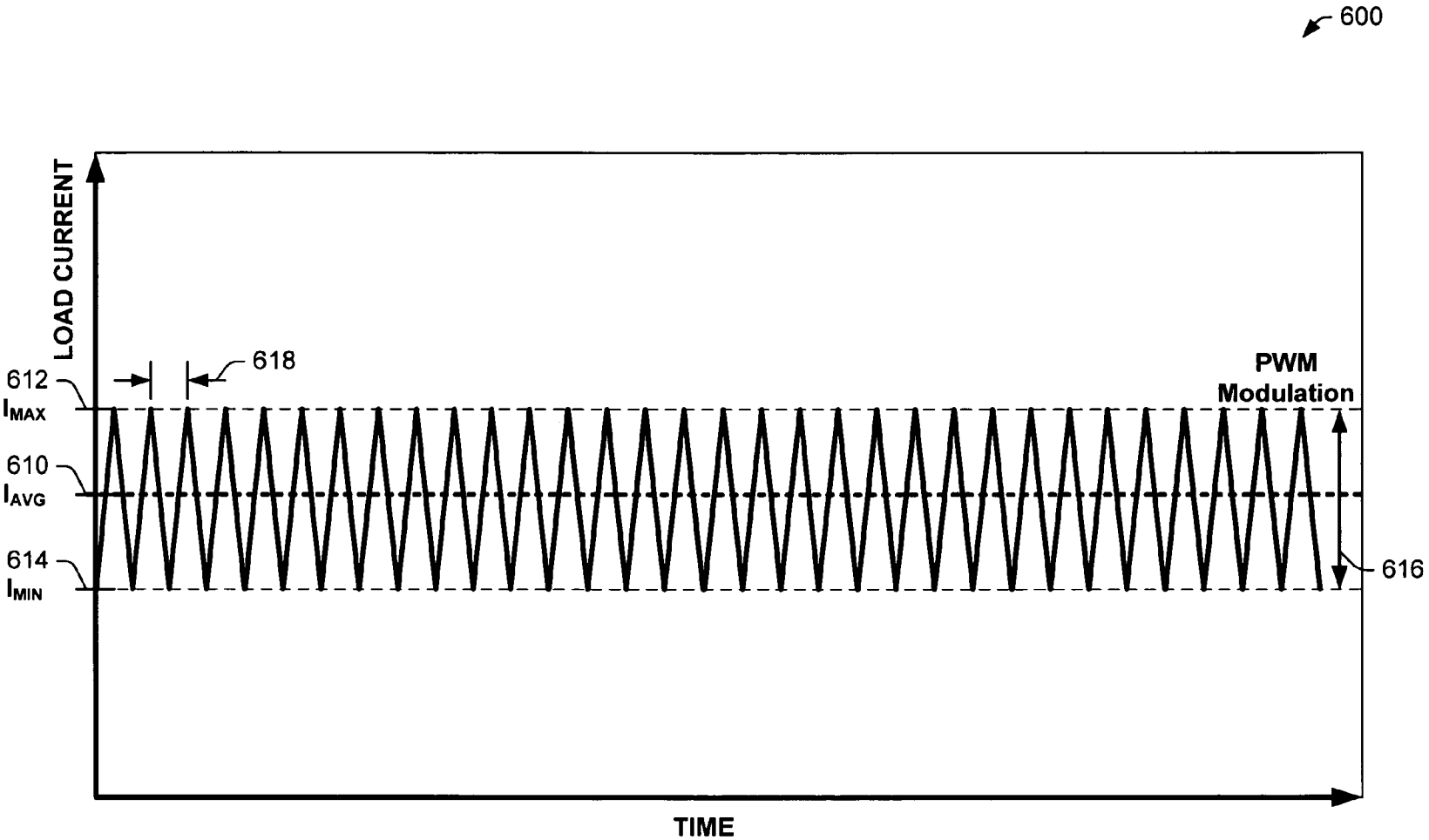
FIG. 6 is an idealized load current output waveform of the control systems of FIGS. 3 and 4 while driving the load without the use of a dither signal.

FIG. 6 illustrates an output waveform 600 of the control system embodiment 300 of FIG. 4 while driving the load 366 without the use of a dither signal 333. The load current, for example is maintained at an average load current $I_{AVG}$ 610, by driving (in one embodiment, switching) the load 366 between preset upper limit $I_{MAX}$ 612 and lower limit $I_{MIN}$ 614, which define a PWM modulation band 616. The PWM modulation band 616 may be programmed along with other initial settings, for example, within the control circuit 300, wherein the amplitude of the PWM modulation occurs as a result of the frequency or period 618 of the clock signal 351, the load voltage VBAT supplied, the load resistance, and inductive component of the system, for example, in the present embodiments.

Figure 7:
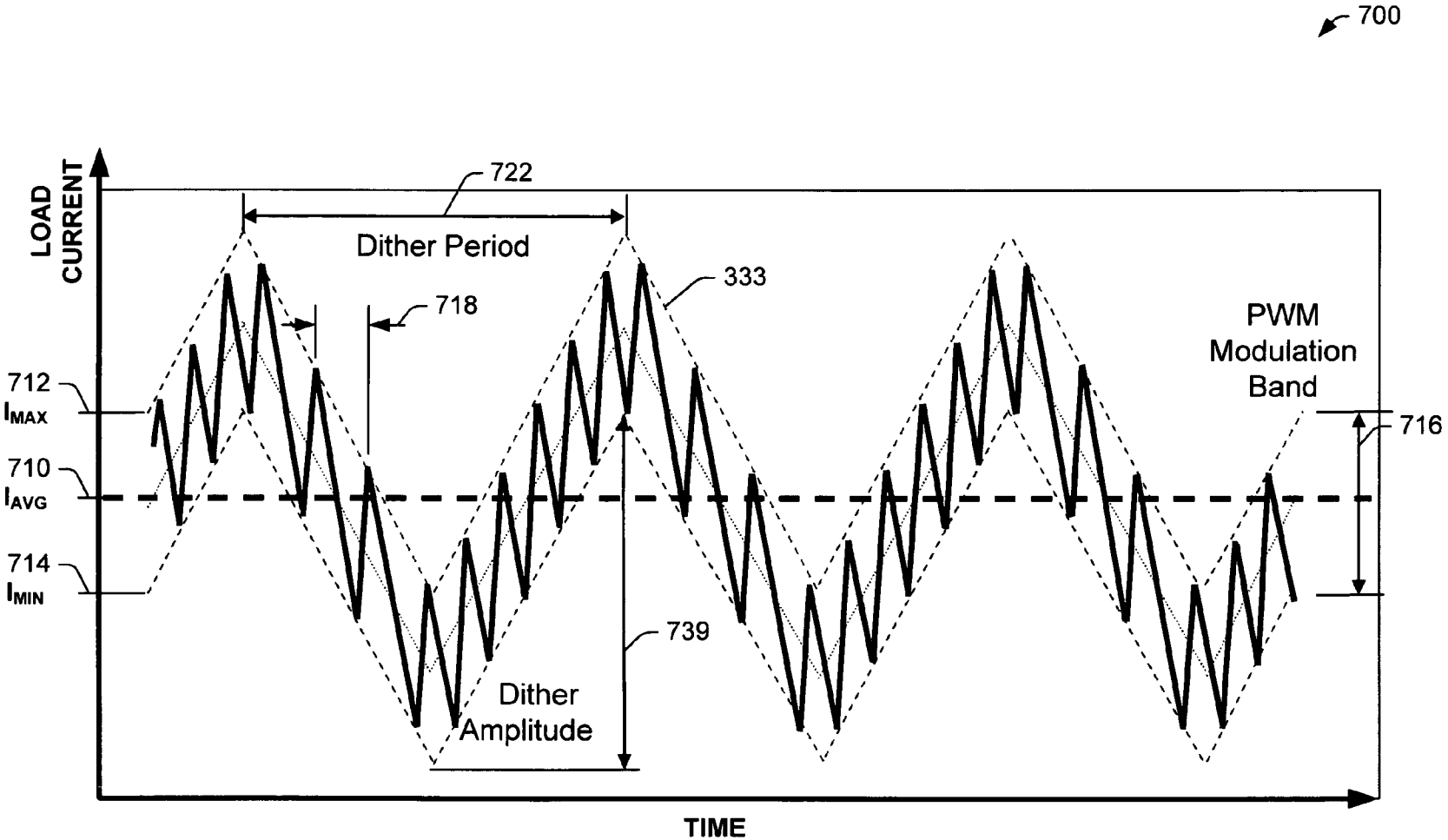
FIG. 7 is an idealized load current output waveform of the control systems of FIGS. 3 and 4 while driving the load with the use of a dither signal to provide substantially continuous motion to the load when operably coupled thereto.
Figure 8:
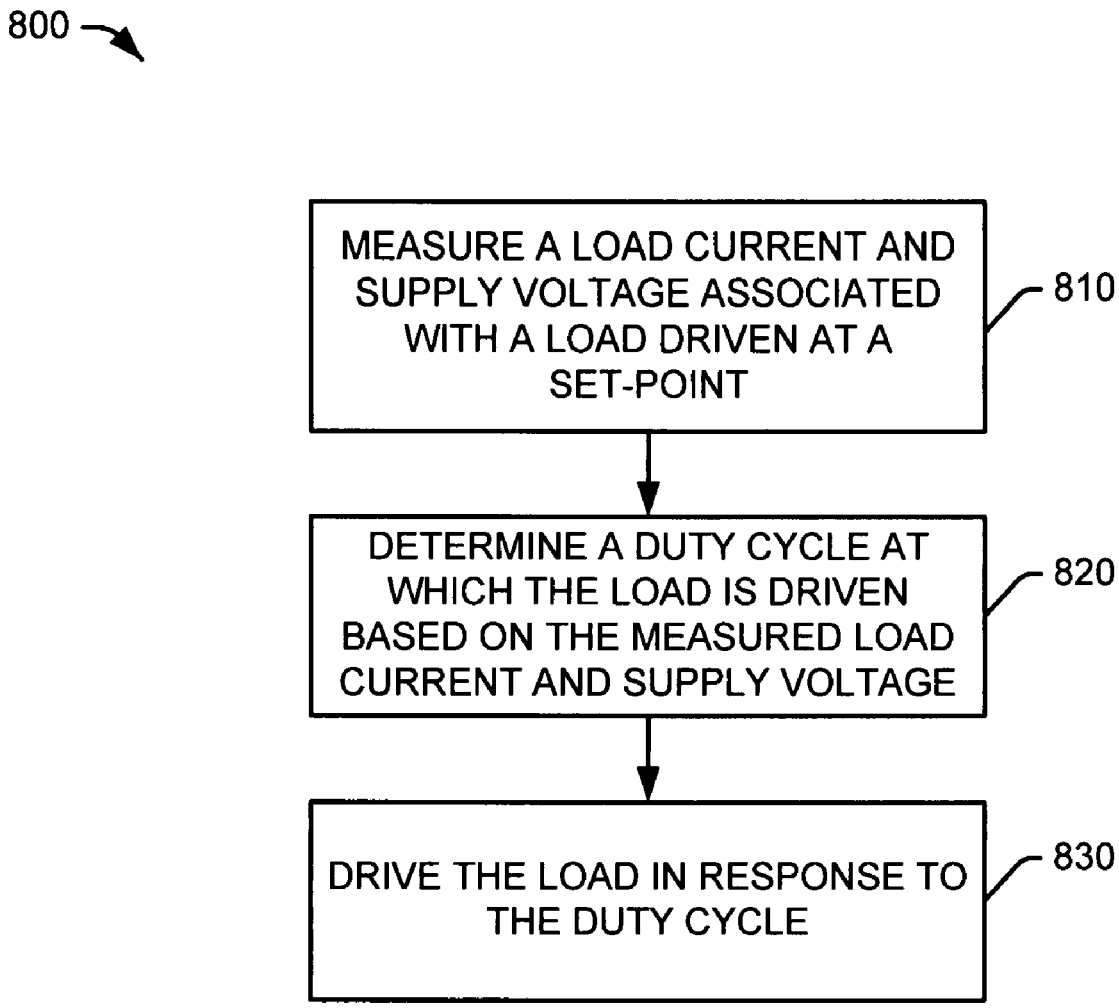
FIG. 8 is a flow chart of one method for driving a load according to one embodiment.

FIG. 7 illustrates an output waveform 700 of the control system embodiment 400 of FIG. 4 having a dither signal 333, and driving the load 366. The load current, for example is maintained at an average load current $I_{AVG}$ 710, by driving (in one embodiment, switching) the load 366 between preset upper limit $I_{MAX}$ 712 and lower limit $I_{MIN}$ 714, which define a PWM modulation band 716. The PWM modulation band 716 may be programmed along with other initial settings, for example, within the control circuit 300 chip. The frequency or period 418 of this load switching is generally determined by the frequency or period 618 of the clock signal 351, the particular load currents, the level of supply voltage used, and the PWM modulation band 716 chosen.

In addition, the dither signal 333 having a dither amplitude 739 and a dither frequency or dither period 722, may be provided by the dither generator 332. The dither generator 332 may be used to provide a substantially continuous motion to the load (in other embodiments, the core or armature of a solenoid or a motor) when operably coupled thereto. Although the clock signal 351 may generally provide the time base for all computations of the control circuit 300, the dither signal 333 may alternately provide a time base source for the average block 330 in one embodiment for computing the average load current 331 over an integer number of dither cycle periods 722. The amplitude component 739 of the dither signal may be summed (or otherwise accounted for) in the embodiment of FIGS. 3 and 4 in summing block 336 with the current set-point 315, and the computed average load current 331, to supply a load current error 341. From FIG. 7, it may be observed that the output waveform 700 essentially comprises the dither signal 333 as an AC signal riding on, or summed with the PWM_out 312 load drive signal or output waveform 600 of FIG. 6 with dither.

In one embodiment, the control system 400 can provide a substantially constant average current upon which a periodic wave is superimposed and wherein the periodic wave has a frequency that is associated with a clock signal 351 and PWM switching frequency for the load, for example, at a frequency of about 2-10 Khz, depending upon the load currents, the supply voltage, and other operating conditions of the system.

In addition to or in substitution of one or more of the illustrated components, the illustrated control circuit, compensated control system and other systems of the invention include suitable circuitry, state machines, firmware, software, logic, etc. to perform the various methods and functions illustrated and described herein, including but not limited to the methods described below. While the methods illustrated herein are illustrated and described as a series of acts or events, it will be appreciated that the present invention is not limited by the illustrated ordering of such acts or events. For example, some acts may occur in different orders and/or concurrently with other acts or events apart from those illustrated and/or described herein, in accordance with the invention. In addition, not all illustrated steps may be required to implement a methodology in accordance with the present invention. Furthermore, the methods according to the present invention may be implemented in association with the operation of systems which are illustrated and described herein (in other embodiments, circuit 300 of FIGS. 3 and 4) as well as in association with other systems not illustrated, wherein all such implementations are contemplated as failing within the scope of the present invention and the appended claims.

Referring now to FIGS. 8-11, one or more embodiments are illustrated of a method 800 in accordance with aspects of the present invention in the context of the control circuits 300 and system 400 of FIGS. 3 and 4. In the method 800, a load current (in other embodiments, a current, a voltage, a magnetic field, a light energy, or a power) associated with a load 366 (in other embodiments, a solenoid, a motor, a light, or an inductive load) driven at a current set-point (e.g., 315), and a load voltage (e.g., VBAT 362) associated with a load 366 is measured and provided at 810. In one embodiment, the load current measurement I_wd 310 and load voltage measurement V_wd 311 may be performed digitally using an analog to digital converter A/D 318 and A/D 320 to supply a digital word representation of the load current 310 and the load voltage 311, respectively, and in order to better facilitate computations of the load measurements, for example, using software based averaging and other such math functions.

At 820, a duty cycle (e.g., a/(a+b) at which the load (e.g., 366) is driven based on the measured load current (e.g., I_wd 310) and measured load voltage (e.g., V_wd 311) is determined.

At 830, the load is driven in response to the determined duty cycle. In one embodiment, the load 366 is driven by MOSFET 370 which is driven by an output driver 324, for example, using a PWM_out 312 drive signal.

Figure 9:
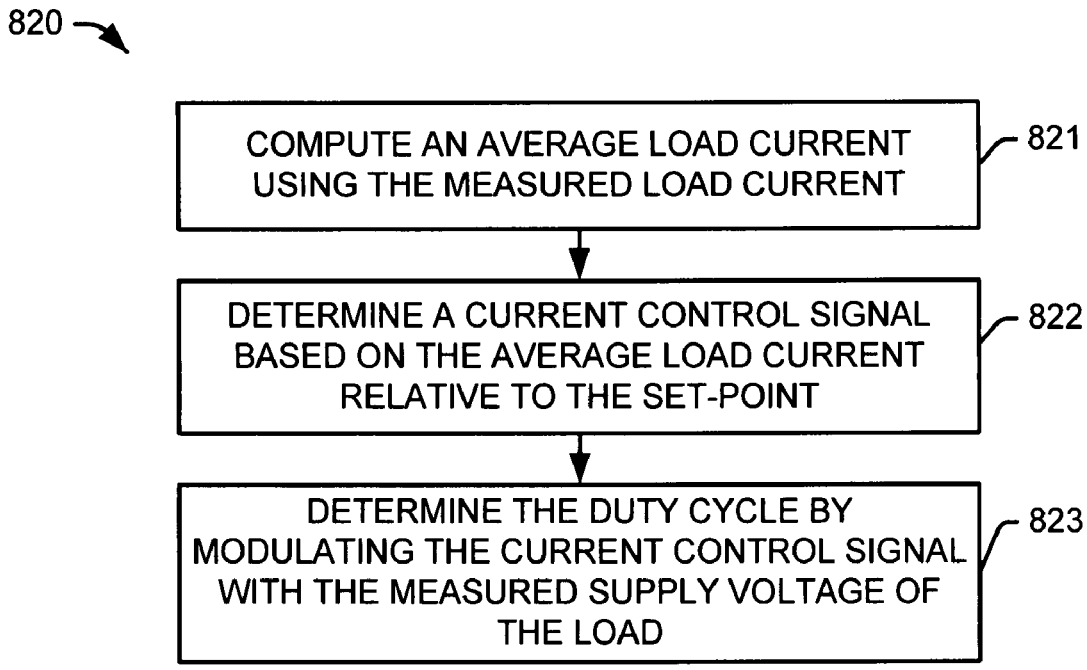
FIGS. 9-11 are flow charts of other embodiments of the method of FIG. 8, used for driving the load.

In another embodiment of step 820 of method 800, the duty cycle determination may be obtained as shown in FIG. 9 by computing an average load current 331 at step 821 using the load current measurement (e.g., I_wd 310), for example, over an integer number of clock signal 351 cycles, or dither cycles 722.

At 822, a current control output signal (e.g., Control_out 345) is determined based on the computed average load current 331 relative to the current set-point 315.

Thereafter, at 823 the duty cycle (e.g., a/(a+b) is determined by modulating the current control output signal with the measured load voltage (e.g., V_wd 311).

Figure 10:
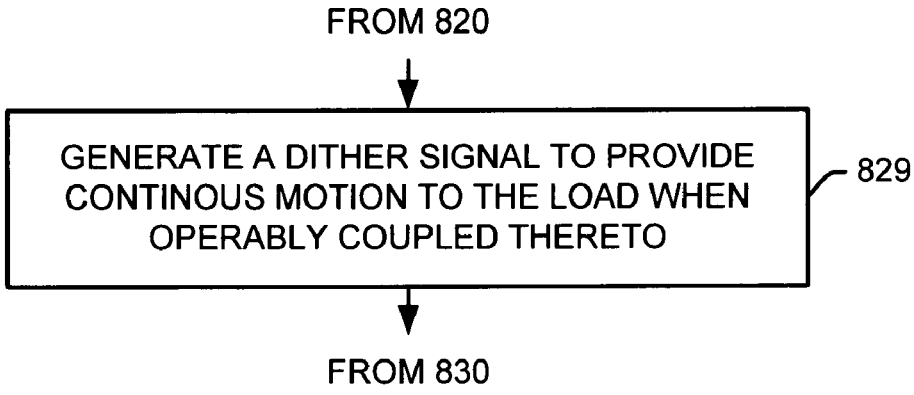

In a further embodiment of method 800, after step 820 and at step 829 of FIG. 10, a dither signal 333 may be generated to provide continuous motion to the load 366 when operably coupled thereto. Thereafter the method 800 of FIG. 10 returns to step 830.

Figure 11:
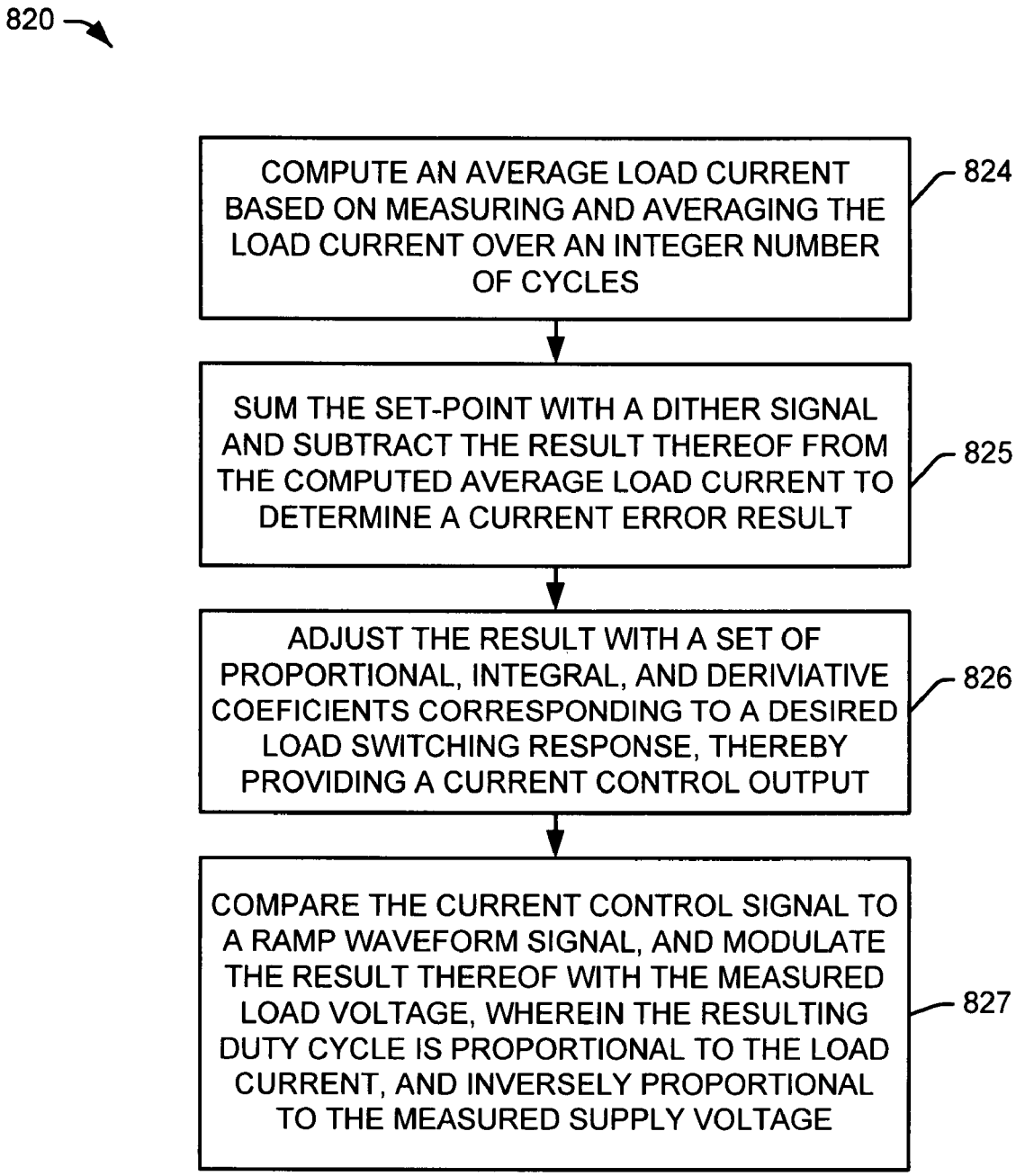

In yet another embodiment of step 820 of method 800, the duty cycle determination may be obtained as shown in FIG. 11, by computing an average load current 331 at step 824 based on measuring and averaging the load current (e.g., I_wd 310), for example, over an integer number of cycles (e.g., clock signal 351 cycles, or dither cycles 722).

At 825, the current set-point 315 is summed with a dither signal 333 and the result thereof subtracted from the computed average load current 331 to determine a current error result 341.

At 826, the result 341 is adjusted with a set of proportional, integral, and derivative coefficients corresponding to a desired load switching response to provide a current control output signal (e.g., Control_out 345).

Thereafter, at 827 the current control output signal (e.g., Control_out 345) is compared to a ramp waveform signal (e.g., 540 of FIG. 5E), and the result thereof is modulated with the measured load voltage (e.g., V_wd 311), wherein the resulting duty cycle is proportional to the average load current (e.g., load current set point 315) and inversely proportional to the measured load voltage (e.g., V_wd 311), thereby providing the duty cycle (e.g., the duty cycle of output PWM_out 312).

Although the invention has been illustrated and described with respect to one or more implementations, alterations and/or modifications may be made to the illustrated examples without departing from the spirit and scope of the appended claims.

For example, in one embodiment, the load could be a solenoid. Further such a solenoid could be employed in an automotive system, such as an automatic transmission. In other embodiments, the load could be any other loads that a user desires to drive at an average load current and frequency.

Further, although in the illustrated embodiment, the one or more transistors are n-type metal-oxide semiconductor field effect transistors (MOSFETs), p-type MOSFETS could also be used including other types of switching devices (in other embodiments, transistors, bipolar junction transistors (BJTs), vacuum tubes, relays, etc.).

In another embodiment, two or more drive transistors similar to FET transistor 370 may be used to switch the load 366. In still another embodiment, the FET 370 of FIGS. 3 and 4 may be located at the high side of the load, attached to the power supply VBAT 362 rather than to the ground Vgnd 363. Numerous other such variations are also possible within the spirit and scope of the invention, and as such are anticipated.

In addition, although various embodiments may indicate that a current delivered to the load could be increased if one of the measured voltage exceeds another, the conventions used herein could also be reversed. Thus, one will understand that increases or decreases in voltage or other variables could be transposed or otherwise rearranged in various embodiments.

Further, in various embodiments, portions of the control circuit 300 and system 400 may be integrated into an integrated circuit, although in other embodiments the control system may be comprised of discrete devices. In one embodiment, portions of the external drive components may be integrated into a single IC with the controller 302 and/or the correction circuit 304. The load current sensor, for example, may be integrated into the same IC as the controller, or may be integrated into the same package as the controller, or may be integrated onto the same PCB board, or may be otherwise associated with the control system; depending on the implementation.

In particular regard to the various functions performed by the above described components or structures (blocks, units, engines, assemblies, devices, circuits, systems, etc.), the terms (including a reference to a "means") used to describe such components are intended to correspond, unless otherwise indicated, to any component or structure which performs the specified function of the described component (or another functionally equivalent embodiment), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and the claims, such terms are intended to be inclusive in a manner similar to the term "comprising". In addition, to the extent that the terms "number", "plurality", "series", or variants thereof are used in the detailed description or claims, such terms are to include any number including, but not limited to: positive integers, negative integers, zero, and other values.

What is claimed is:

1. A control system, comprising:

a control circuit configured to drive a load based on a set-point of the load, a measured load characteristic and a supply voltage of the load, and to determine a duty cycle based on the load characteristic, the set-point, and the measured supply voltage, and wherein the control circuit is further configured to drive the load in response to the duty cycle, wherein the control circuit is further configured to compute an average load current based on the load characteristic, and wherein the control circuit is further configured to determine the duty cycle by:

summing the set-point with a dither signal, and subtracting the result thereof from the average load current.

2. The system of claim 1, wherein the load characteristic is a load current.

3. The system of claim 1, wherein the control circuit further comprises a PWM generator configured to provide a pulse width modulated signal having the duty cycle that is proportional to the load current set-point and inversely proportional to the supply voltage.

4. The system of claim 1, wherein the control circuit is further configured to determine the duty cycle by:

adjusting the result with a set of proportional, integral, and derivative coefficients corresponding to a desired average load current response behavior to provide a current controller output, and comparing the current controller output to a ramp waveform signal associated with the supply voltage, and wherein a result of the comparison provides a pulse width modulated signal having the duty cycle that is proportional to the set point and inversely proportional to the supply voltage.

5. A control system, comprising:

a control circuit configured to drive a load based on a set-point of the load, a measured load characteristic and a supply voltage of the load, and to determine a duty cycle based on the load characteristic, the set-point, and the measured supply voltage, wherein the control circuit is configured to drive the load in response to the duty cycle;

an average computation block configured to compute an average load current based on a measurement of the load characteristic taken over an integer number of load switching cycles;

logic configured to subtract the average load current from a result based on the set-point and provide a current error result;

a PID controller configured to determine a current controller output by adjusting the current error result with a set of proportional, integral, and derivative coefficients corresponding to a desired average load current response behavior; and a PWM generator configured to modulate the current controller output signal with the measured supply voltage and provide a pulse width modulated signal having the duty cycle that is proportional to the load current set-point and inversely proportional to the supply voltage of the load.

6. The system of claim 5, wherein the load characteristic is a load current.

7. The system of claim 4, further comprising a driver circuit configured to drive the load in response to the duty cycle and provide a substantially constant current to the load.

8. The system of claim 1, wherein the control system comprises one of a state machine, a microcontroller or a custom integrated circuit.

9. A compensated switching control system, comprising:

measurement means for measuring a load current and a supply voltage associated with a load;

output means for driving the load according to a set-point of the load; and control means for determining a duty cycle from the measured load current, the set-point, and the measured supply voltage, wherein the output means drives the load in response to the duty cycle;

wherein the control means is further configured to compute an average load current based on a measurement of the load current taken over an integer number of load switching cycles, and wherein the control means is configured to provide a pulse width modulated signal used by the output means for driving the load, the pulse width modulated signal having the duty cycle that is proportional to the average load current and inversely proportional to the supply voltage.

10. The system of claim 9, wherein the output means drives the load in response to the duty cycle of the pulse width modulated signal to provide a substantially constant average current to the load.

11. A control system, comprising:

a controller configured to measure a load current and a supply voltage of a load at respective inputs thereof, and further configured to drive the load based on a set-point of the load; and a correction circuit configured to compute an average load current using the measured load current of the load over an integer number of cycles and sum a result thereof with the set-point and a dither signal, determine a current controller output based on the average load current relative to the set-point, and determine a duty cycle by modulating the current controller output with the measured supply voltage, wherein the controller is further configured to drive the load in response to the duty cycle determined by the correction circuit, and wherein the correction circuit is further configured to determine the duty cycle by:

summing the current set-point with a dither signal, subtracting the result thereof from the computed average load current.

12. The system of claim 11, wherein the control system comprises one of a state machine, a microcontroller, or a custom integrated circuit.

13. The system of claim 11, wherein the correction circuit further comprises a dither generator configured to generate the dither signal to provide substantially continuous motion to the load when operably coupled thereto.

14. The system of claim 11, wherein the correction circuit is further configured to determine the duty cycle by:

adjusting the result with a set of proportional, integral, and derivative coefficients corresponding to a desired average load current response behavior to determine a current controller output, comparing the current controller output to a ramp waveform signal associated with the measured supply voltage, wherein the period of the ramp wave-form signal is proportional to a clock rate and the slope rate of the signal is proportional to the measured supply voltage, and wherein the result of the comparison provides a pulse width modulated signal having a duty cycle that is proportional to the computed average load current and inversely proportional to the supply voltage of the load as driven by the controller.

15. The system of claim 11, wherein the controller further comprises:

an analog-to-digital converter configured to measure the load current and supply voltage of the load, and to convert the load current and supply voltage measurements to one or more digital words;

an average computation block configured to compute an average load current based on a measurement of the load current taken over an integer number of load switching cycles;

a dither generator configured to generate a dither signal to provide substantially continuous motion to the load when operably coupled thereto;

a digital summer configured to sum the current set-point and the dither signal and to provide a summation result;

a digital subtractor configured to subtract the computed average load current from the summation result and to provide a current error result;

a PID controller configured to determine a current controller output by adjusting the current error result with a set of proportional, integral, and derivative coefficients corresponding to a desired average load current response behavior;

a PWM generator configured to modulate the current controller output with the measured supply voltage to provide a pulse width modulated signal having a duty cycle that is proportional to the computed average load current and inversely proportional to the supply voltage of the load; and a driver circuit configured to drive the load in response to the duty cycle of the pulse width modulated signal.

16. A method of driving a load, comprising:

measuring a load characteristic and a supply voltage associated with the load;

determining a duty cycle at which the load is driven, the duty cycle based on the measured load characteristic and the supply voltage;

driving the load in response to the duty cycle; and computing an average load current using the measured load characteristic;

wherein the duty cycle is further determined by:

summing a current set-point with a dither signal, subtracting the result thereof from the computed average load current.

17. The method of claim 16, further comprising:

determining a current control output based on the computed average load current relative to the set-point; and determining a duty cycle by modulating the current control output with the measured supply voltage.

18. The method of claim 16, further comprising:

generating a dither signal to provide substantially continuous motion to the load when operably coupled thereto.

19. The method of claim 16, wherein measuring the load characteristic and the supply voltage of the load further comprises measuring a load current and converting the load current and supply voltage to one or more digital words.

20. The method of claim 17, wherein computing an average load current comprises using and averaging the measured load characteristic over one of an integer number of clock cycles, PWM periods, dither cycles, or cycles.

21. A method of driving a load, comprising:

measuring a load characteristic and a supply voltage associated with the load;

determining a duty cycle at which the load is driven, the duty cycle based on the measured load characteristic and the supply voltage;

computing an average load current by using and averaging the measured load characteristic over one of an integer number of clock cycles, PWM periods, dither cycles, or cycles;

determining a current control output based on the computed average load current relative to the set-point, by summing the set-point with a dither signal, and subtracting the result thereof from the computed average load current;

determining the duty cycle by modulating the current control output with the measured supply voltage; and driving the load in response to the duty cycle, wherein determining the current control output further comprises adjusting the result with a set of proportional, integral, and derivative coefficients corresponding to a desired load switching response behavior.

22. The method of claim 21, wherein determining a duty cycle by modulating the current control output with the measured supply voltage further comprises comparing the current control output to a ramp wave-form signal corresponding to the measured supply voltage, wherein the period of the ramp wave-form signal is proportional to a clock rate, and the slope rate is proportional to the measured supply voltage.

23. The method of claim 16, wherein the load characteristic is a load current.

24. The method of claim 16, wherein determining the duty cycle at which the load is driven, the duty cycle based on the measured load current and supply voltage, comprises determining the duty cycle according to:

$$\text{duty cycle} = \frac{\text{load_current} \cdot (\text{load_resistance} + \text{shunt_resistance})}{\text{load_voltage}}$$

where load current is the set-point load current, load_voltage is the measured supply voltage at the load, load_resistance is a resistance of the load, shunt_resistance is a resistance of a shunt device connected in series with the load, across which the load current is measured.

25. The system of claim 1, wherein the control circuit is further configured to drive the load in response to the duty cycle with a substantially constant average current which is substantially independent of the supply voltage.

26. The system of claim 1, wherein the control circuit further comprises a PWM generator configured to provide the duty cycle comprising a pulse width modulated signal that is proportional to the load current set-point.

27. The system of claim 9, wherein the substantially constant average current is substantially independent of the supply voltage.

28. The system of claim 9, wherein the duty cycle comprises a pulse width modulated signal that is proportional to the set-point of the load.

29. The system of claim 11, wherein the controller is further configured to drive the load in response to the duty cycle with a substantially constant average current which is substantially independent of the supply voltage.

30. The method of claim 16, wherein driving the load in response to the duty cycle comprises driving the load in response to the duty cycle with a substantially constant average current which is substantially independent of the supply voltage.

31. The method of claim 16, wherein the duty cycle comprises a pulse width modulated signal that is proportional to the measured load characteristic.

32. The method of claim 16, further comprising:

adjusting the result with a set of proportional, integral, and derivative coefficients corresponding to a desired average load current response behavior to provide a current controller output, and comparing the current controller output to a ramp wave-form signal associated with the supply voltage, and wherein a result of the comparison provides a pulse width modulated signal having the duty cycle that is proportional to the set point and inversely proportional to the supply voltage.

* * * * *

UNITED STATES PATENT AND TRADEMARK OFFICE

CERTIFICATE OF CORRECTION

PATENT NO. : 7,872,845 B2
APPLICATION NO. : 11/731722
DATED : January 18, 2011
INVENTOR(S) : Kyle Shawn Williams et al.

It is certified that error appears in the above-identified patent and that said Letters Patent is hereby corrected as shown below:

Column 13, Claim 7, Line 39; please replace "claim 4" with --claim 5--

Signed and Sealed this
First Day of March, 2011

David J. Kappos

David J. Kappos
*Director of the United States Patent and Trademark Office*